US005222611A

United States Patent [19]

Wood et al.

[11] Patent Number: 5,222,611

[45] Date of Patent: Jun. 29, 1993

[54] WALL-UNIT HANGING SYSTEM

[76] Inventors: Robert G. Wood, 2238 Eton Ridge, Madison, Wis. 53705; Timothy J. McGrath, 485 Highway MM, Brooklyn, Wis. 53521

[21] Appl. No.: 858,276

[22] Filed: Mar. 26, 1992

[51] Int. Cl.[5] ..... A47F 5/08

[52] U.S. Cl. ..... 211/94; 248/339; 312/245

[58] Field of Search ..... 211/94, 90, 187; 312/245; 248/225.2, 307, 339

[56] References Cited

U.S. PATENT DOCUMENTS 3,117,353 1/1964 Edwards .
3,532,317 10/1970 Adler .
3,899,228 8/1975 Schreiber .
3,950,049 4/1976 Drass .
4,133,507 1/1979 Chervenak .
4,160,570 7/1979 Bridges .
4,165,852 8/1979 Chervenak .
4,206,955 6/1980 Cooper .
4,311,295 1/1982 Jamar, Jr. .
4,329,003 5/1982 Manchester .
4,403,761 9/1983 Jamar .
4,457,436 7/1984 Kelley .
4,711,419 12/1987 Polosky .
4,826,115 5/1989 Novitski .
4,928,833 5/1990 Huizenga .
4,988,007 1/1991 Chiarot .
5,050,832 9/1991 Lee et al. .

*Primary Examiner*—Blair M. Johnson
*Attorney, Agent, or Firm*—Ross & Stevens, S.C.

[57] ABSTRACT

A wall-unit hanging system for hanging shelves, cabinets, drawers or the like on a wall is described. The system includes a mounting rail and one or more vertical panels. Each vertical panel has a cut-out portion and an associated bracket for securing the vertical panel to the mounting rail. The vertical panel is secured to the mounting rail by moving the panel perpendicularly with respect to the wall until the panel is flushed with the wall and the cut-out portion has received the mounting rail. The mounting bracket engages a projection in the mounting rail in order to secure the vertical panels to the mounting rail.

14 Claims, 5 Drawing Sheets

WALL-UNIT HANGING SYSTEM

FIELD OF THE INVENTION

The present invention is directed to a system designed to hang structures on a wall. The invention is particularly related to a wall-unit hanging system and a method for installing the same. The wall units can be shelves, cabinets, hanging rods, or a combination of these features.

BACKGROUND OF THE INVENTION

The present invention is directed to a system for organizing specific areas, for example, closets, workshops and the like. Taking a closet as an example, it is common for closets to be only provided with a hanging rod and one or two shelves above the rod. This setup results in an abundance of wasted space. By carefully planning this space, the entire closet area can be organized to provide a system which maximizes the area efficiency through the addition of and the reorganization of shelves, drawers, cabinets and hanging rods. The majority of these features are designed to be adjustable for periodic reorganization, depending upon the needs of the user.

Various devices and methods have been developed for mounting shelves, cabinets and the like on a wall. Reference is made to the following patents which disclose examples of these systems.

U.S. Pat. No. 5,050,832 to Lee et al. discloses a storage unit mounting system, which includes a horizontal support rail and a hanging bracket designed to be attached to a vertical panel on the storage unit.

U.S. Pat. No. 4,457,436 to Kelley discloses a similar locking engagement system for a storage unit.

U.S. Pat. No. 4,403,761 to Jamar. Jr. is directed to a similar-type bracket structure. U.S. Pat. No. 4,329,003 to Manchester discloses a system for supporting storage units, which includes an L-shaped support rail having dual L-shaped channels and designed to fit with a cooperating hanging bracket.

U.S. Pat. No. 4,928,833 to Huizenga is directed to a storage organizer system and a means for installing the same. The system described in Huizenga includes a horizontal mounting rail mounted on a wall and having a projection extending away from the wall. The shelf system includes a plurality of vertical panels, each having a cut-out portion, such that the panel is designed to be moved perpendicular to the wall and dropped down and over the projection to mount the panel to the horizontal railing.

The prior art wall-unit mounting systems suffer from some disadvantages. Some of the systems do not have a strong enough retaining mechanism to withstand the force of gravity. Therefore, there is a high risk of failure, i.e., the possibility that the wall hanging system will fall from the mounting rail. A further disadvantage is that the present systems cannot be constructed to mount to the wall in such a way that the vertical panels are flush with the ceiling.

SUMMARY OF THE INVENTION

The present invention is designed to overcome the deficiencies expressed above by providing a wall-unit hanging system comprising a mounting rail adapted to be attached to a wall. The rail includes a projection, which extends upwardly and outwardly from the wall, when the rail is attached to the wall. The system also includes at least one vertical panel, and preferably a plurality of vertical panels. The vertical panels are adapted to be supported by the rail and to extend perpendicular from the wall. The edge of the panel adjoining the wall has a cut-out portion substantially corresponding to the dimensions of the mounting rail. The system also includes a bracket slidably mounted adjacent to the cut-out portion of the vertical panel. The bracket includes a hook for securing the vertical panel to the projection on the rail. There are also means to fix or tighten the bracket to the vertical panel after the hook has engaged the projection on the mounting rail.

The present invention is also directed to a method for installing a wall-unit hanging system. The system includes attaching the mounting rail to a wall. At least one vertical panel is attached to the rail by moving the panel perpendicularly to the wall. A cut-out portion in one edge of the vertical panel then receives the mounting rail. The bracket, which is slidably mounted on the panel, is moved down the vertical panel to engage the projection on the rail. The bracket includes a hook for securing the vertical panel to the projection on the rail. After engagement, the bracket is tightened to the panel.

The present invention advantageously provides a low-cost wall hanging system that is simple and easy to install. Once the vertical panels are installed, attachments to the vertical panels such as shelves, cabinets, drawers, clothes rods and the like, can then be mounted in a manner known to the art.

The presently claimed invention also provides a system in which the vertical panels may be mounted flush with the ceiling. In other words, the vertical panel does not have to slide vertically down the wall over any projection on the mounting rail.

The system is also designed to have the vertical panel rest on the mounting rail rather than being suspended on the hardware attached to the vertical panel. This strengthens the point of attachment.

The present invention provides a useful wall-unit hanging system, designed for hanging shelves, rods, cabinets, drawers and the like. Further, the invention is designed to provide a system that is easily installed.

Further objects, features and advantages of the invention will be apparent from the following detailed description when taken in conjunction with the accompanying drawings.

DETAILED DESCRIPTION OF THE INVENTION

Figure 1:
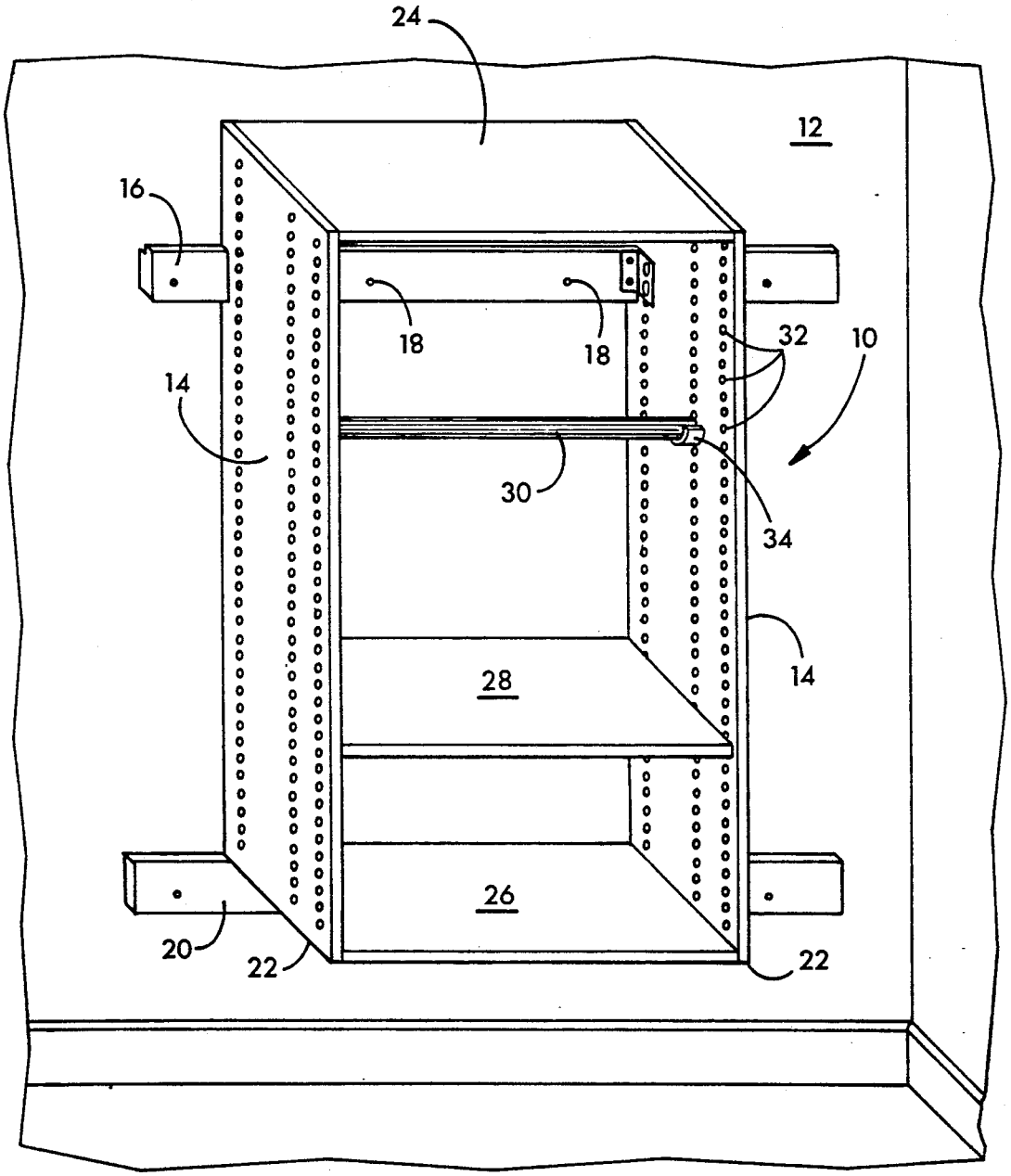
FIG. 1 is a front perspective view of a wall-unit hanging system of the present invention.

Referring to the drawings, FIG. 1 illustrates a wall-unit hanging system of the present invention, generally designated by reference numeral 10. The system is designed to be attached to and hung on a wall 12. The system 10 includes at least one, and preferably a plurality, of vertical panel(s) 14. Although two panels are illustrated in FIG. 1, it is within the scope of the present invention to have several panels in the system. The panels are attached to the wall 12 by a mounting rail 16 in a manner which will be described shortly.

The mounting rail 16 may be made of a variety of materials which have the structural integrity to support the vertical panels 14 and any attachments. Preferably, the mounting rail 16 is a shaped wooden board having a suitable length and width. The board may be laminated according to the user's taste. Other materials suitable for the mounting rail 16 include composite materials, plastics and metal.

Figure 7:
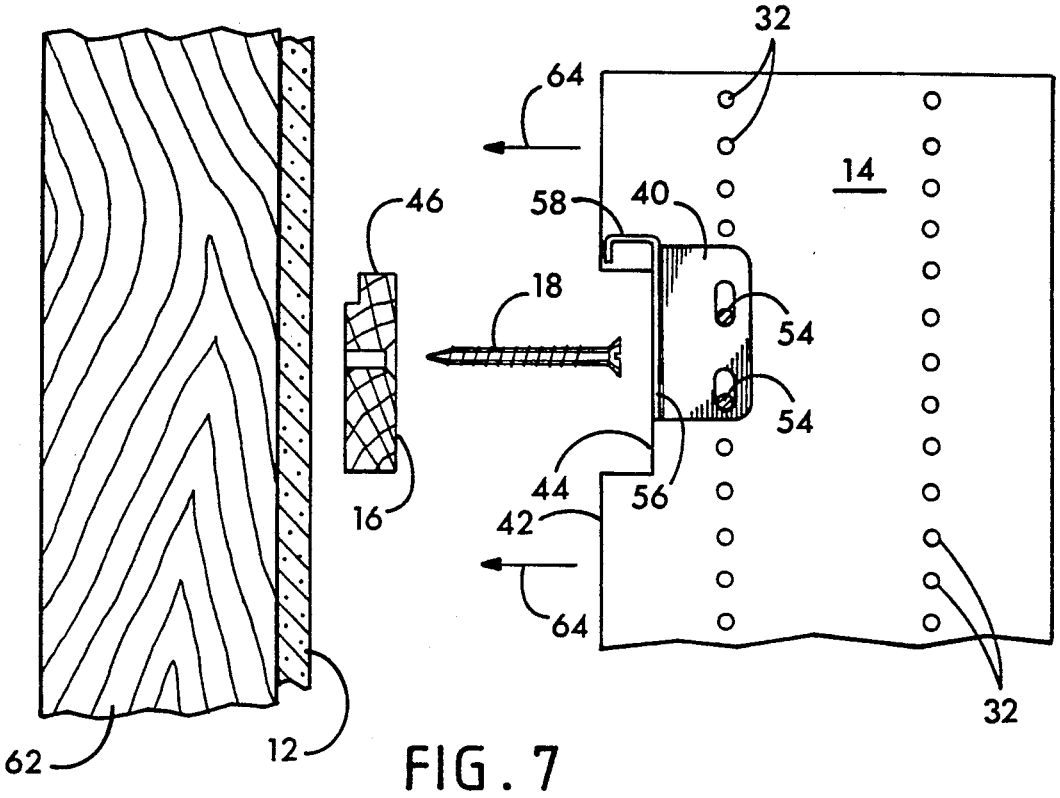
FIG. 7 is a partially exploded side elevational view of a portion of the wall-unit hanging system of the present invention.
Figure 8:
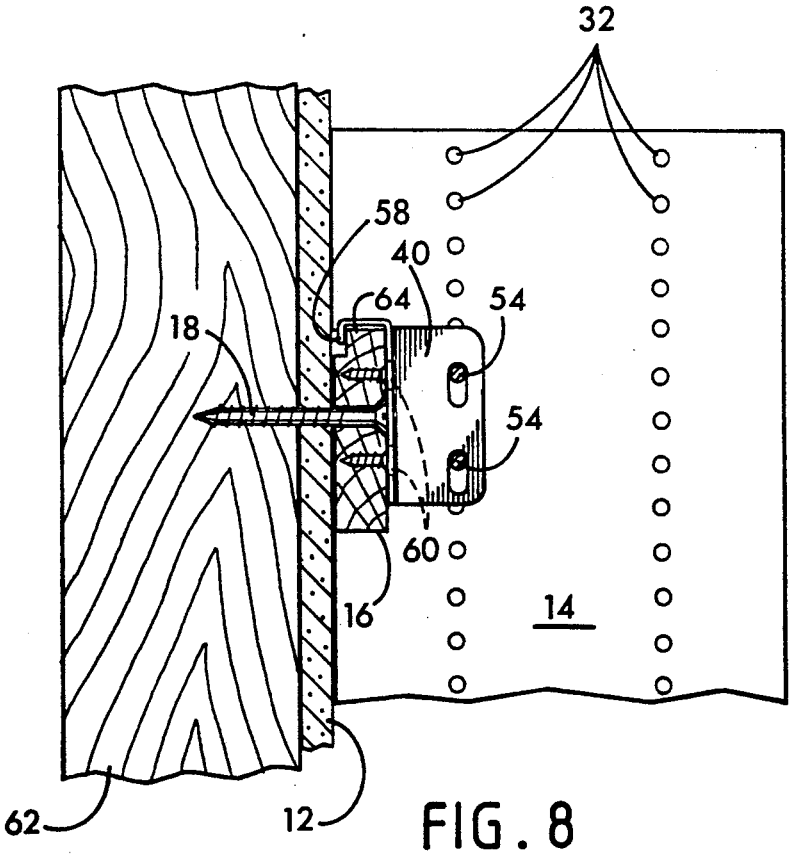
FIG. 8 is a side elevational view of the wall hanging system of FIG. 8 illustrating the placement of the vertical panel and bracket on the mounting rail.

The mounting rail 16 is mounted to the wall 12 by fasteners in the form of screws, bolts, nails or other means known to the art and designated by reference numeral 18. For purposes of the present invention and unless otherwise designated, the term "fastener" will be used to designate devices such as screws, pins, nails and bolts, which are designed to fasten to objects together. The fasteners 18 are preferably located to enter a vertical stud behind the wall 12. Reference is made to FIGS. 7 and 8 for an illustration of a vertical stud 62.

The system 10 may also include a cleat 20, placed beneath the lower edge 22 of the vertical panel 14. The cleat 20 can be added if further support is necessary.

The system 10 also includes horizontal support members in the form of end shelves 24, 26, respectively, one or more interior shelves 28 and a hanging or clothes rod 30. The end shelves 24, 26 may be permanently affixed to the vertical panels 14 by permanent fasteners in order to provide a structural box-like integrity to the system 10. Alternatively, the shelves 24, 26 may be positioned on removable fasteners, such as pegs (not illustrated) which are placed in apertures 32 in the vertical panels 14. Likewise, the internal shelf 28 and the hanging rod 30 may be removable or permanently affixed to the vertical panels 14 by shelf pegs and/or hanging rod pegs 34.

Figure 2:
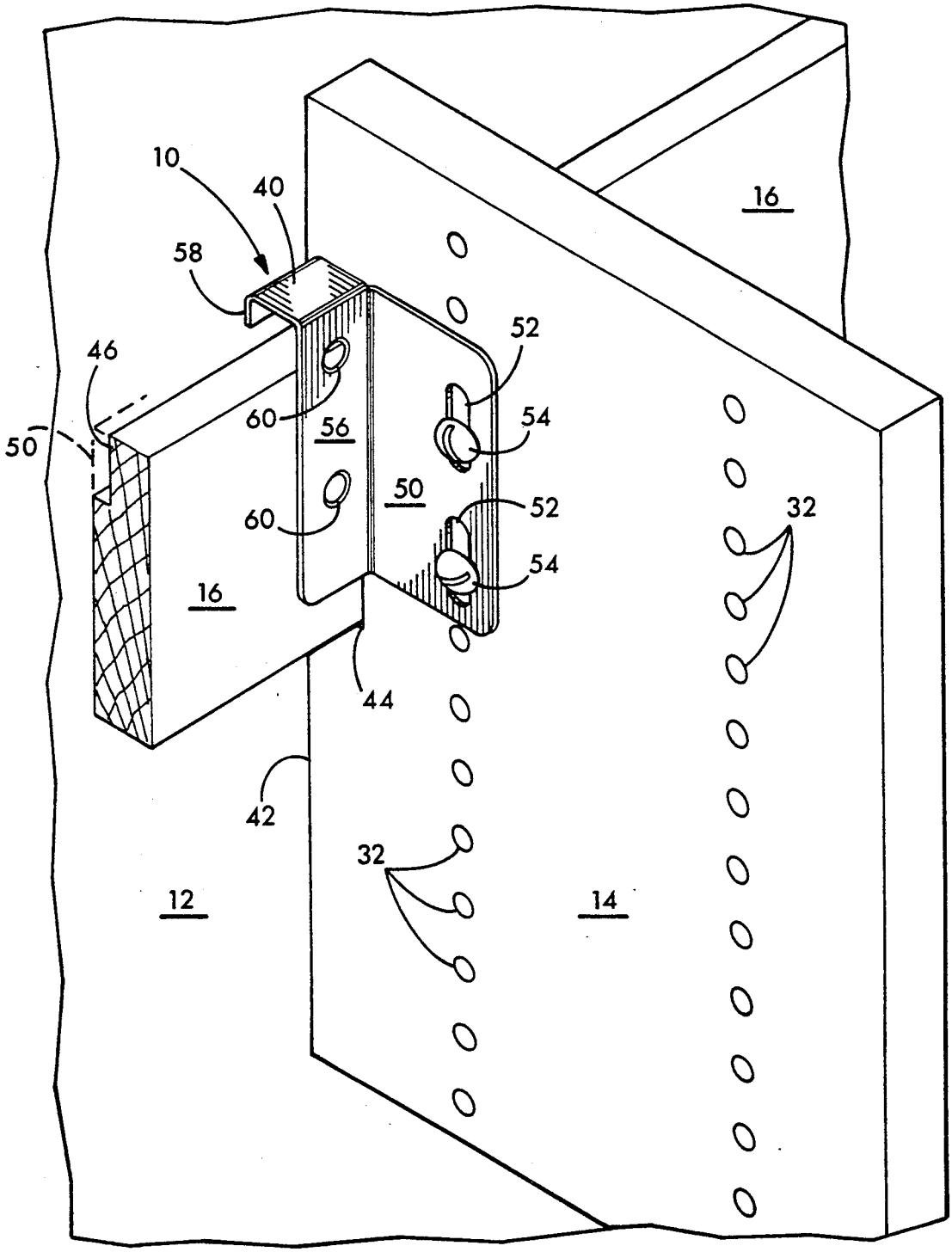
FIG. 2 is a front perspective view of a portion of the wall-unit hanging system illustrating the placement of the vertical panel on the mounting rail.
Figure 3:
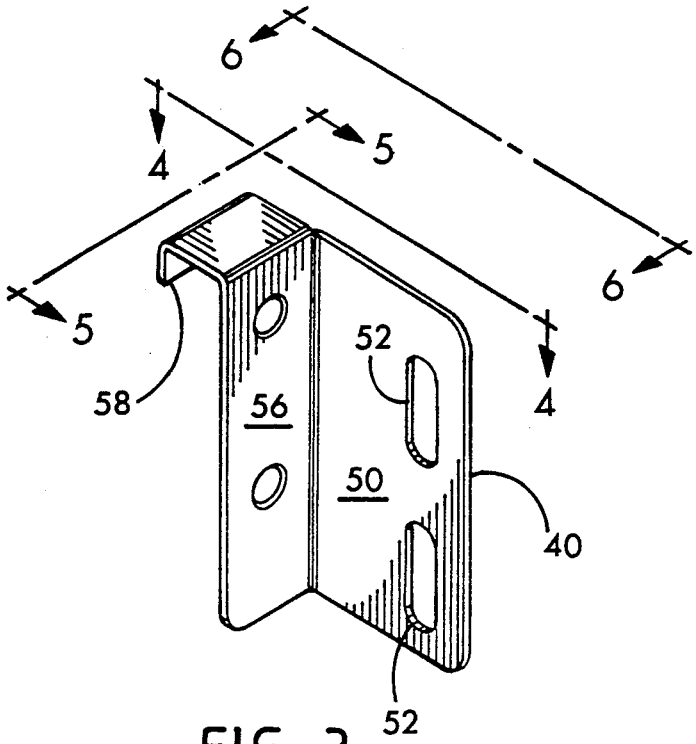
FIG. 3 is a perspective view of a bracket, which is utilized in the present invention.
Figure 4:
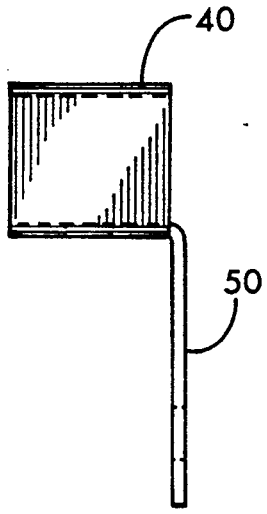
FIG. 4 is a top elevational view of the bracket of FIG. 3 taken along lines 4—4 of FIG. 3.
Figure 5:
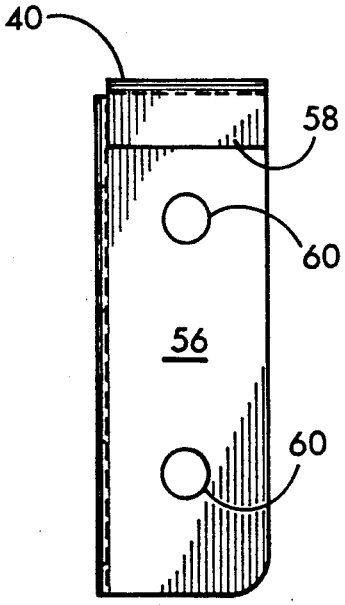
FIG. 5 is a front elevational view of the bracket of FIG. 3 taken along lines 5—5 of FIG. 3.
Figure 6:
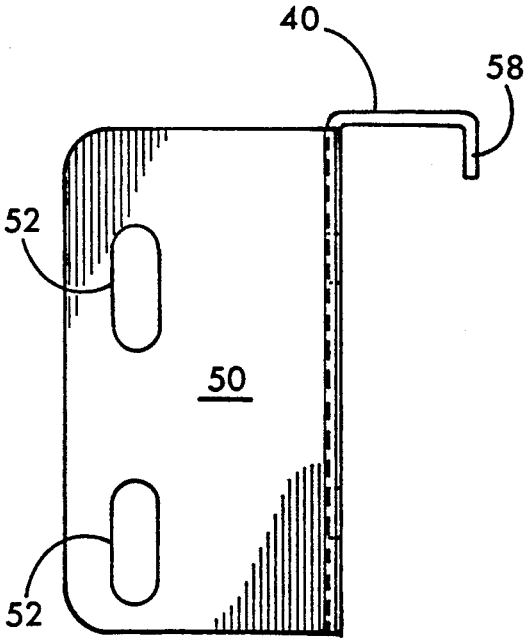
FIG. 6 is a side elevational view of the bracket of FIG. 3 taken along lines 6—6 of FIG. 3.

Referring now to FIG. 2, there is illustrated a portion of the system 10, which includes the mounting rail 16, a vertical panel 14 with apertures 32 and a mounting bracket 40. The vertical panel 14 is defined by an edge 42, which abuts the wall 12. The edge 42 is further defined by a cut-out portion 44, also illustrated in FIG. 7, which is designed to receive the mounting rail 16. It is an advantage of the present invention to provide the cut-out portion 44 having dimensions substantially similar to the width and depth of the mounting rail 16. In this manner, the vertical panel 14 can mount flush with the mounting rail 16 and avoid the appearance of a gap in the inner edge 42 of the vertical panel 14.

The mounting rail 16 is further defined by a projection 46. The projection 46 is broadly designed to extend outward and upward from the wall 12. As illustrated in FIGS. 2 and 7–10, the projection 46 can be formed by removing a portion 48 of the mounting rail 16, which leaves a groove between the wall 12 and the projection 46.

Referring now to FIGS. 2–6, the bracket 40 is shaped to secure the vertical panel 14 to the mounting rail 16. It is within the scope of the present invention to construct the bracket of a variety of materials, which will support the structural integrity of the system 10. The bracket is preferably made of a metal, such as aluminum, steel or the like. The bracket may be formed from a flat sheet of metal, which is cut out and bent to form a piece substantially as illustrated in the figures.

The bracket 40 includes a panel side 50 designed for placement adjacent the vertical panels 14. The panel side 50 is defined by one or more elongated slots 52. The elongated slots align with the vertical panel apertures 32 to affix the bracket 40 to the vertical panel 14 by fasteners 54. Preferably, screws or bolts traverse the slots 52 and apertures 32 in order to affix the bracket 40 to the vertical panel. The purpose for providing the panel side 50 with elongated slots 52 is to allow the bracket 40 to move upwardly or downwardly in order to engage to disengage the vertical panel 14 with the mounting rail 16 as required. The bracket 40 may be tightened to the panel 14 in either the up position, as illustrated in FIGS. 2 and 7, or the down position, as illustrated in FIG. 8.

The bracket 40 is also defined by a railing side 56, which is generally at a right angle to the panel side 50. The railing side 56 is elongated at the upper end and bent to form a hook 58, which hook is designed to conform to the shape of the projection 46. The railing side 56 may also include slots 60 for driving fasteners into the mounting rail 16, when the bracket 40 is in engaging relationship with the mounting rail 16.

Referring now to FIG. 7, the manner of attaching the vertical panel to the wall structure will be discussed. The mounting rail 16 is affixed to the wall 12 by securing mechanisms 18 known to the art. Preferably, the securing mechanism 18 will engage a wooden stud 62, located behind the wall 12. The vertical panel 14 is then moved in the direction of arrows 64 until the cut-out portion 44 envelopes the mounting rail 16. As illustrated in FIG. 7, the bracket 40 is in the up or disengaged mode.

Referring now to FIG. 8, once the vertical panel 14 is in placement, the panel is aligned perpendicularly with respect to the wall 12; and the bracket 40 is lowered such that the hook 58 is placed in engaging relationship over the projection 46 of the mounting rail 16. The securing mechanisms 54 are then tightened to affix the vertical panel 14 and the mounting bracket 40 in locking relationship on the mounting rail 16.

The vertical panel 14 is advantageously mounted on the mounting rail 16 in such a manner to enable the panel to slide horizontally with respect to the mounting rail 16. Therefore, adjustments can be made if necessary. Securing screws are then preferably placed in the slots 60 on the railing side 56 to provide added security to the integrity of the mounting rail/bracket/vertical panel combination.

Figure 9:
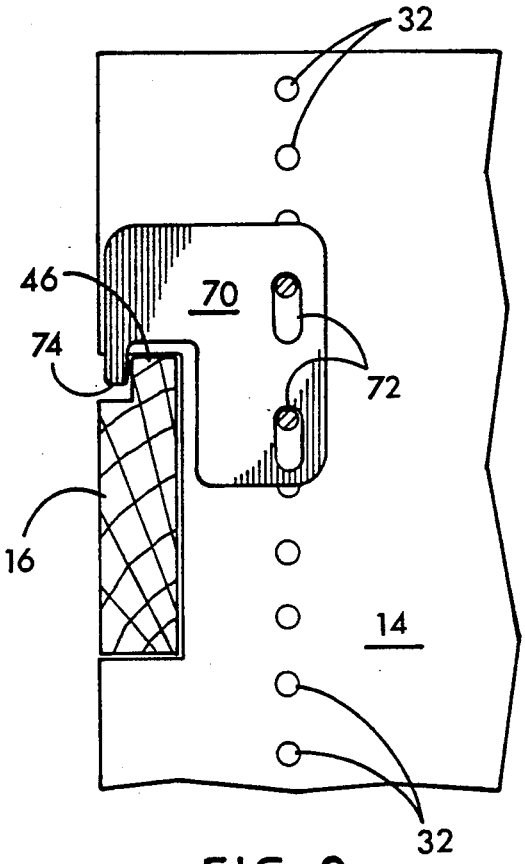
FIGS. 9 and 10 are side elevational and perspective views respectively of a first alternative embodiment of the wall-unit hanging system of the present invention.
Figure 10:
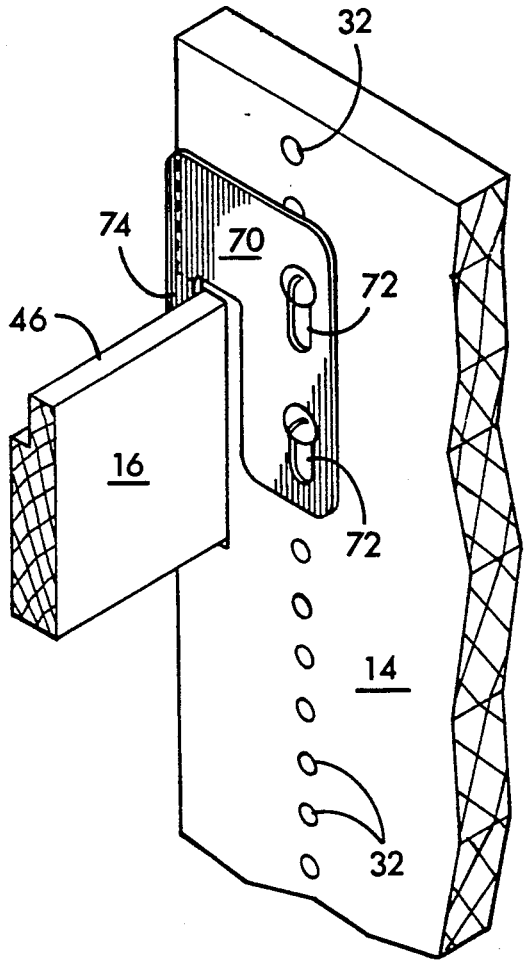

Reference is now made to FIGS. 9 and 10 for an alternative embodiment to the bracket 40. Illustrated in FIGS. 9 and 10 is a bracket 70, which is a planar piece of metal comprising elongated slots 72 and an attachment hook 74 for placement over the projection 46 of the mounting rail 16.

Figure 11:
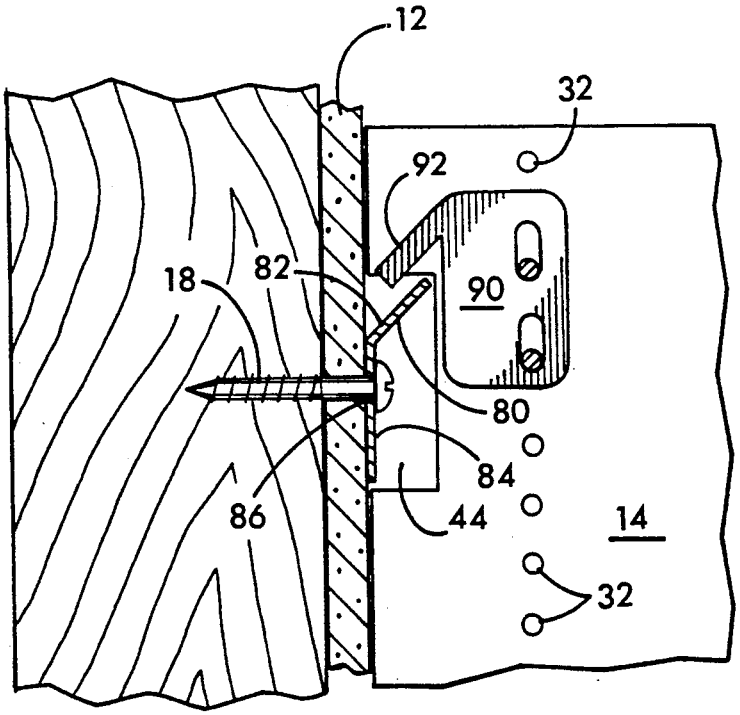
FIG. 11 is a side elevational view of a second alternative embodiment of the wall-unit hanging system of the present invention.

Reference is made to FIG. 11 for a second alternative embodiment to the present invention. In FIG. 11, the mounting rail 80 is an elongated metal rail having two legs 82 and 84. The legs 82, 84 are arranged at an angle with respect to each other. One leg 84 is provided with slots 86 in order to attach the mounting rail 80 to a wall 12 by some mounting mechanism 18. In this manner, the leg 82 projects upwardly and outwardly from the wall 12 at an angle, which must be less than 90° from the wall 12. Also illustrated in FIG. 11 is an alternative embodiment to a bracket 90, which bracket is designed to conform to the shape of the mounting rail 80. The vertical panel 14 includes a cut-out portion 44. The vertical panel 14 is placed alongside the wall 12 in the manner described previously. The bracket 90 is designed to slide such that its hook 92 engages the leg 82 of the mounting rail 80. The bracket 90 may then be affixed to the vertical panel 14 in the manner described previously.

It is understood that the invention is not confined to the particular construction and arrangement herein illustrated and described, but embraces such modified forms thereof as come within the scope of the following claims.

What is claimed is:

1. A wall-unit hanging system adapted to detachably mount to a wall comprising:

a. a mounting rail adapted to be mounted to the wall, the rail comprising a projection extending upwardly and outwardly from the wall;

b. at least one vertical panel adapted to directly engage and be supported by the mounting rail and to extend perpendicularly from the wall, the panel having an edge adjoining the wall, the edge having a cutout portion substantially corresponding to the dimensions of the mounting rail for receiving the mounting rail when the vertical panel is moved perpendicular to the wall such that the cutout portion is substantially contiguous to the mounting rail when the mounting rail is received by the cutout portion;

c. a J-shaped bracket slidably mounted on the vertical panel, the bracket including a hook for slidably engaging the projection on the mounting rail; and d. means to tighten the bracket to the vertical panel when the hook engages the projection.

2. The wall hanging system of claim 1 wherein the projection is shaped to receive the bracket hook as the hook is slid into engagement with the mounting rail.

3. The wall hanging system of claim 1 wherein the panel is adapted to be slidably engaged to the rail after the bracket has been secured to the panel.

4. The wall-unit hanging system of claim 1 further comprising means to tighten the bracket to the vertical panel after the hook is in engagement with the projection on the mounting rail to engage the panel to the rail.

5. The wall hanging system of claim 1 comprising means to secure the bracket to the rail after the vertical panel has been secured to the rail.

6. The wall hanging system of claim 1 comprising a plurality of vertical panels and a plurality of horizontal structures positioned between the vertical panels.

7. The wall hanging system of claim 6 wherein the horizontal structures include shelving.

8. The wall hanging system of claim 6 wherein the horizontal structures include rods.

9. A method for installing a wall hanging system comprising:

a. attaching a mounting rail to a wall, the rail comprising a projection extending upwardly and outwardly from the wall;

b. engaging a vertical panel to the mounting rail by moving the vertical panel perpendicularly to the wall, wherein the vertical panel has an edge adjoining the wall and the edge has a cutout portion substantially corresponding to the dimensions of the mounting rail such that the cutout portion is substantially contiguous to the mounting rail when the mounting rail is received by the cutout portion, the vertical panel further including a bracket slidably mounted adjacent the cutout portion of the vertical panel such that the bracket does not engage the rail, the bracket including a hook for slidably engaging the projection on the mounting rail and means to tighten the bracket to the panel after the hook is in engagement with the projection on the rail;

c. sliding the bracket hook over the projection to secure the panel to the rail.

10. The method of claim 9 wherein the panel is slidably positioned on the rail after the bracket has been secured to the panel.

11. The method of claim 9 comprising securing the bracket to the rail after the vertical panel has been secured to the rail.

12. The method of claim 9 comprising attaching a plurality of vertical panels to the mounting rail and a positioning a plurality of horizontal structures between the vertical panels.

13. The method of claim 9 wherein the horizontal structures include shelving.

14. The method of claim 9 wherein the horizontal structures include rods.

* * * * *